United States Patent [19]

Kronich

[11] Patent Number: 4,905,636

[45] Date of Patent: Mar. 6, 1990

[54] ANTI-PUDDLING TURBULENCE INDUCING CYLINDER HEAD INTAKE PORT AND MANIFOLD

[75] Inventor: Peter G. Kronich, Sheboygan, Wis.

[73] Assignee: Tecumseh Products Company, Tecumseh, Mich.

[21] Appl. No.: 348,808

[22] Filed: May 8, 1989

[51] Int. Cl.[4] ..... F02M 35/10

[52] U.S. Cl. ..... 123/52 MC; 123/195 HC; 123/73 C

[58] Field of Search ..... 123/52 M, 52 MC, 73 C, 123/196 W, 195 HC, 195 P, 73 A, 73 B, 41.56, 41.7

[56] References Cited

U.S. PATENT DOCUMENTS

| | | | |
|---|---|---|---|
| 3,393,984 | 7/1968 | Wisman . | |
| 3,874,357 | 4/1975 | List et al. . | |
| 4,123,996 | 11/1978 | Gillbrand et al. . | |
| 4,180,041 | 12/1979 | Miyazaki et al. . | |
| 4,548,167 | 10/1985 | Tamba et al. | 123/195 HC |
| 4,570,584 | 2/1986 | Uetsuji et al. | 123/196 W |
| 4,658,767 | 4/1987 | Fujikawa et al. | 123/195 HC |
| 4,671,057 | 6/1987 | Kronich . | |
| 4,756,280 | 7/1988 | Tamba et al. | 123/196 W |

FOREIGN PATENT DOCUMENTS 8501778 4/1985 PCT Int'l Appl. ..... 123/52 M

*Primary Examiner*—David A. Okonsky

*Attorney, Agent, or Firm*—Albert L. Jeffers; Richard L. Robinson

[57] ABSTRACT

An intake manifold and cylinder head intake passageway for an air-cooled internal combustion engine. The manifold is substantially S-shaped and generally vertically oriented and communicates a carburetor having a horizonal bore with an overhead valve cylinder head having a horizontal intake passageway located at an elevation above that of the carburetor. The manifold has a turbulence inducing ridge at the entrance from the carburetor and the cylinder head intake passageway has a similar ridge at the entrance from the manifold. Each elbow bend in the manifold and in the cylinder head passageway is provided with a flat area at the outside curve of the bend which prevents puddling of fuel in the arcuate section of the bend and which causes any fuel which collects there to be spread out in a thin film which is then reintroduced into the air stream by a wedge-shaped ridge transverse to the flat area and rising therefrom to a ridge peak.

17 Claims, 2 Drawing Sheets

ANTI-PUDDLING TURBULENCE INDUCING CYLINDER HEAD INTAKE PORT AND MANIFOLD

BACKGROUND OF THE INVENTION

1. Field of the Invention

The present invention relates generally to carbureted single-cylinder internal combustion engines, and more particularly to an intake manifold and intake port for same.

2. Description of the Related Art

In single cylinder air-cooled gasoline engines the induction system from the carburetor to the intake port of the cylinder head is often sized for minimum flow restriction and maximum induction flow area in order to obtain maximum power. This arrangement is satisfactory in achieving high power at wide open throttle. At lower speeds, however, the air stream within the induction system has a low velocity, is essentially streamlined, and lacks the turbulence necessary to keep the fuel in suspension. Under such low flow conditions a fluid stream of gasoline will tend to separate out and migrate along the walls of the induction system. This effect is most pronounced at elbow bends and at manifold joint sections where the manifold joins the carburetor and the cylinder head intake port. The gasoline which separates out tends to collect in puddles, especially where the geometry of the induction system involves arcuate sections and elbow bends. Such puddles can result in the feeding of nonhomogeneous nonstoichiometric mixtures to the combustion chamber even though the carburetor is maintaining a correct fuel/air mixture because the gasoline settles out within the induction system as the air flow decreases and is picked up again by the air stream as the air flow increases. Thus, the mixture alternates between being overly lean and overly rich. Consequently, on acceleration from idle, the fuel/air mixture introduced into the combustion chamber is extremely over-rich, causing the engine to emit black exhaust smoke, stumble, lag and sometimes stall.

It would be desireable to provide an induction system for small air-cooled internal combustion engines which maintains a homogeneous mixture of the fuel and air between the carburetor and the intake valve even at closed throttle conditions such as idle, while not unduly restricting flow at wide open throttle.

SUMMARY OF THE INVENTION

The present invention involves an intake manifold and cylinder head intake passageway whose regular cross-section is strategically varied at selected locations to generate turbulence in the air stream at low flow conditions to help prevent puddling of fuel, and to reintroduce back into the air stream fuel which may have separated out.

Provided by the present invention are abruptly rising ridges located at the transition joints from the carburetor to the manifold and from the manifold to the cylinder head. These ridges introduce turbulence at those locations to prevent fuel from settling out. Also provided at the elbow bends in the manifold or cylinder head passageway are flat areas on the outside curve of the bend where fuel would otherwise tend to puddle. The flat areas prevent the fuel from puddling in what would ordinarily be arcuate shaped portions of the passage, and instead cause any fuel which may have collected there to be spread out in a thin film on the flat area to enhance vaporization. In addition, the flat areas can be provided with wedge-shaped ridges oriented transversely to the direction of air flow. These ridges cause the film of fuel which is spread out by the flat areas to be directed away from the passage wall into the air stream where it is re-atomized at the ridge peak.

The invention, according to one aspect thereof, provides in an air-cooled internal combustion engine having an intake port and a carburetor, an intake manifold including an elongate manifold tube having at least one elbow bend having an outer wall. The manifold tube has a generally arcuate internal cross-section, and the outer wall of the manifold tube at the elbow bend has a first planar internal surface, such that the internal cross-section of the manifold tube undergoes transition from arcuate to flat at the elbow bend. A ridge is located on the first planar internal surface and oriented transverse to the manifold tube. The ridge includes a stoss side rising from a grade defined by the first planar internal surface to a ridge peak, and a lee side descending from the ridge peak back to grade.

It is an object of the present invention to provide an improved induction system for an air-cooled internal combustion engine which maintains delivery of a homogeneous fuel/air mixture to the combustion chamber at low speeds while not unduly restricting flow at wide open throttle.

Further objects and advantages of the present invention will become apparent from the following descriptions.

DESCRIPTION OF THE PREFERRED EMBODIMENT

Figure 1:
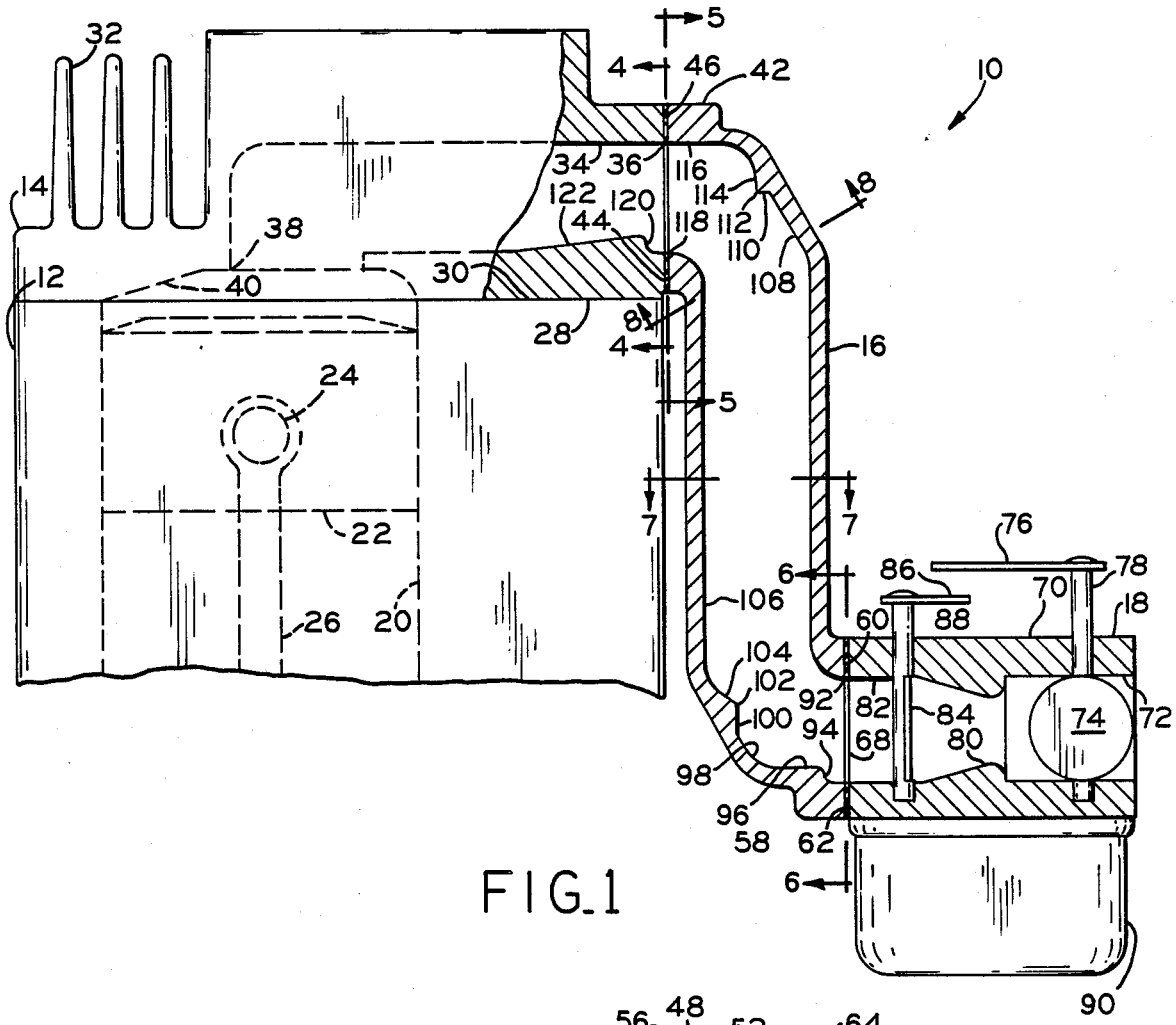
FIG. 1 is an elevational, partly cross-sectional view of the cylinder and cylinder head area of an internal combustion engine, including the intake manifold and carburetor.

Referring particularly to FIG. 1, there is illustrated a portion of an internal combustion engine 10 of the type having a horizontal crankshaft and a vertical cylinder which includes cylinder 12, cylinder head 14, intake manifold 16, and carburetor 18.

Cylinder 12 includes a piston bore 20 having a vertical axis in which a piston 22 is disposed for reciprocation therein. Connected to piston 22 via horizontal wrist pin 24 is a piston rod 26 whose lower end is connected to a horizontal crankshaft (not shown).

Cylinder head 14 is an overhead valve type head having a bottom planar gasket surface 28 mating with a top planar gasket surface 30 of cylinder 12. A gasket (not shown) seals the interface therebetween. Head 14 includes a plurality of integrally cast cooling fins 32 extending therefrom to aid in dissipating heat. Disposed within cylinder head 14 is an intake passageway 34 running generally horizontally from an intake port 36 opening to the exterior of cylinder head 14 to an intake valve port 38 opening to a cylinder head space 40 in cylinder head 14 which is aligned with cylinder bore 20 and forms the top wall of the combustion chamber. Intake valve port 38 is periodically occluded by a reciprocating overhead valve (not shown) located therein in conventional fashion.

Intake manifold 16 is disposed exteriorly of cylinder 12 and cylinder head 14 and is substantially S-shaped and generally vertically oriented. Manifold 16 includes a horizontally oriented top end portion 42 which is relatively short in relation to the overall length of manifold 16 and has a planar end face 44 in mating engagement with a corresponding planar end face 46 of cylinder head 14. A pair of transverse flanges 48 and 50 (see FIG. 2) on end portion 42 receive a pair of bolts 52 and 54 which secure manifold 16 to cylinder head 14 and compress sealing gasket 56 between end faces 44 and 46. A relatively short horizontally oriented bottom end portion 58 of manifold 16 has a planar end face 60 in mating engagement with a corresponding planar end face 62 of carburetor 18. A pair of transverse flanges 64 and 66 (see FIG. 2) on end portion 58 are secured to carburetor 18 by bolts (not shown) with a sealing gasket 68 compressed between end faces 60 and 62.

Carburetor 18 is illustrated in FIG. 1 in a somewhat simplified form, comprising a carburetor body 70 having a bore therethrough including a first section 72 through which air flow is controlled by a choke valve 74 which is rotatable through linkage 76 via shaft 78. The bore further includes a venturi throat section 80 at which fuel is introduced into the bore by means not shown, and a further section 82 downstream through which air flow is controlled by a throttle valve 84 which is rotatable through linkage 86 via shaft 88. Carburetor 18 is also provided with a float bowl 90.

Figure 5:
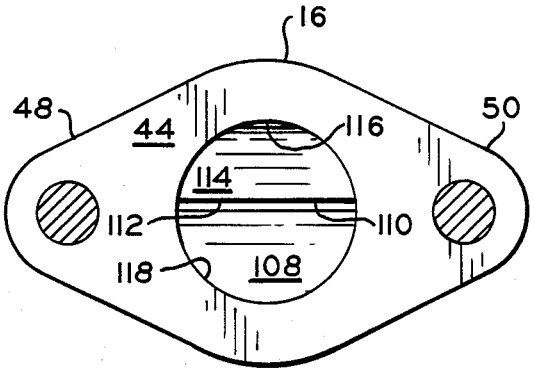
FIG. 5 is a fragmentary cross-sectional view of the intake manifold of FIG. 1, taken along section line 5—5 of FIG. 1 and viewed in the direction of the arrows.
Figure 6:
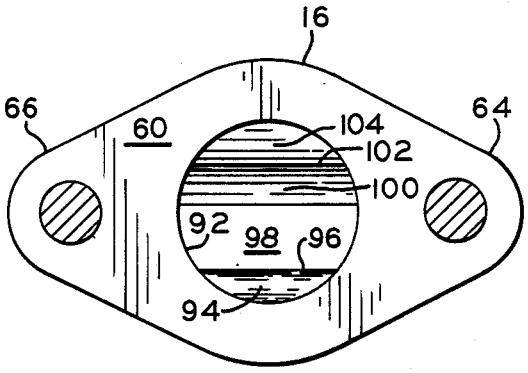
FIG. 6 is a fragmentary cross-sectional view of the intake manifold of FIG. 1, taken along section line 6—6 of FIG. 1 and viewed in the direction of the arrows.
Figure 7:
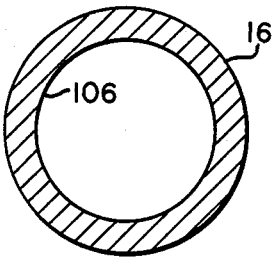
FIG. 7 is a cross-sectional view of the intake manifold of FIG. 1, taken along section line 7—7 of FIG. 1 and viewed in the direction of the arrows.
Figure 8:
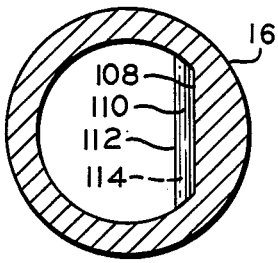
FIG. 8 is a cross-sectional view of the intake manifold of FIG. 1, taken along section line 8—8 of FIG. 1 and viewed in the direction of the arrows.

Manifold 16 is a generally S-shaped tube whose cross-section deviates from round in particular areas to achieve improved fuel/air mixture. The entrance to manifold 16, viewed in a direction toward end face 60 (see FIG. 6) involves a round intake port 92 whose round cross-section is maintained for a short distance into manifold 16 and then is abruptly interrupted by a rapidly rising ridge 94 at the bottom thereof having a plateau surface 96 lying parallel to a chord of the round intake cross-section. Plateau surface 96 extends substantially horizontally into manifold 16 and intersects the inner surface of the upwardly curving back wall 98 of S-shaped manifold 16 at the lower elbow thereof (at the outside curve of the bend) such that plateau surface 96 gives way to a planar surface 98 disposed at an angle of about 60° from horizontal. Surface 98 extends through a portion of the bend at the lower elbow and then is interrupted by a vertical planar wall 100 which extends upwardly a short distance and then breaks at peak 102, with the immediately following section 104 comprising a planar wall disposed at an angle of about 30° from horizontal. Said another way, planar surface 98 has a wedge-shaped ridge thereon comprising a stoss side 100 rising from a grade defined by surface 98 at an angle of about 30° to a ridge peak 102, from whence the lee side 104 descends at an angle of about 30° back down to grade. Planar section 104 gives way to a following intermediate section 106 of manifold 16 which is of round cross-section and vertically oriented. Intermediate section 106 extends upwardly to the top elbow of manifold 16, whereupon further cross-sectional deviations are encountered, as shown particularly in FIGS. 1 and 8. A planer surface 108 is disposed at an angle of about 60° from horizontal at the outside curve of the bend at the top elbow. Surface 108 is interrupted by a wedge shaped ridge having a stoss side 110 which is oriented horizontally or, said another way, rises at an angle of about 60° from a grade defined by surface 108. Stoss surface 110 terminates at a ridge peak 112, and is followed thereafter by a lee side 114 which is nearly vertical or, said another way, descends from ridge peak 112 at an angle of about 30° back down to grade. Lee surface 114 undergoes transition to an immediately following section 116 having a round cross-section and terminating in round exit port 118, as shown in FIG. 5. Exit port 118 of manifold 16 is aligned with and communicates with intake port 36 of cylinder head 14.

Figure 4:
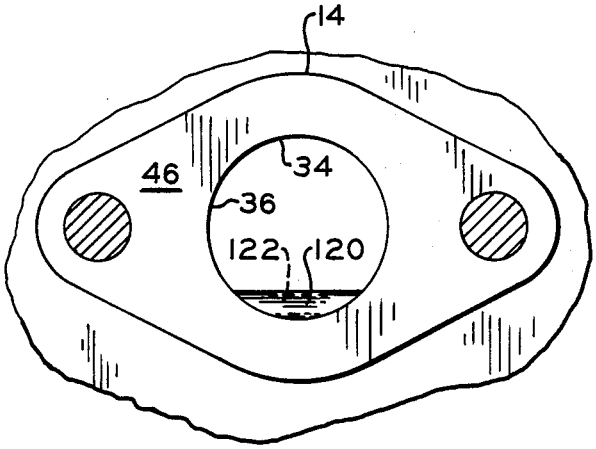
FIG. 4 is a fragmentary cross-sectional view of the intake port of the cylinder head of FIG. 2, taken along section line 4—4 of FIG. 1 and viewed in the direction of the arrows.

Viewed in the direction of flow (see FIGS. 1 and 4), intake port 36 of cylinder head 14 is of round cross-section, and is followed by an abruptly rising ridge 120 at the bottom of intake passageway 34. Ridge 120 is followed by a gently descending planar sloped portion 122 which undergoes transition back to the round cross-section of passageway 34.

Figure 2:
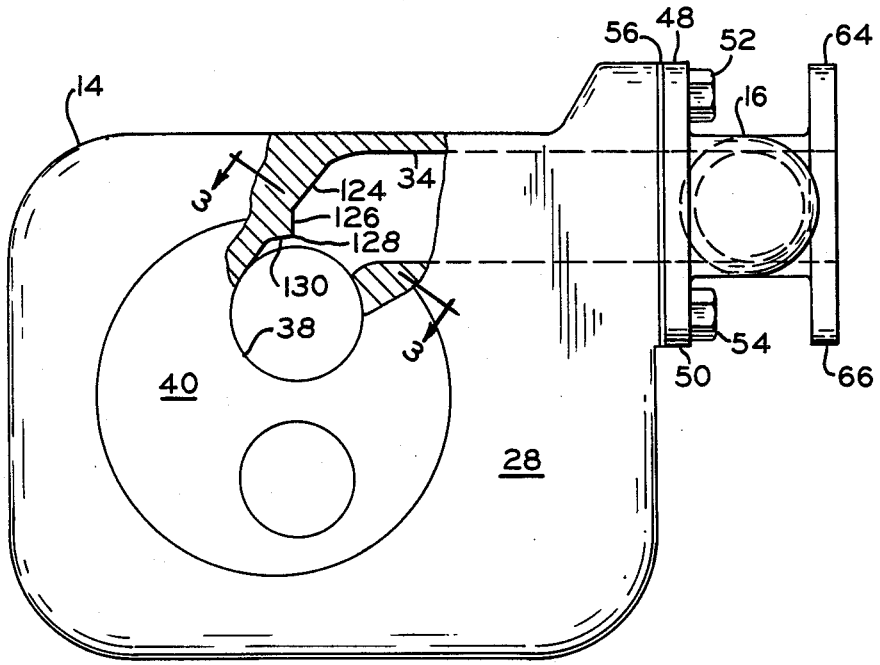
FIG. 2 is a bottom plan view, partly in cross-section, of the cylinder head and manifold of FIG. 1.
Figure 3:
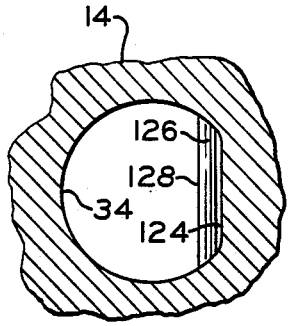
FIG. 3 is a fragmentary cross-sectional view of the intake port of the cylinder head of FIG. 2, taken along section line 3—3 of FIG. 2 and viewed in the direction of the arrows.

Referring particularly to FIGS. 2 and 3, intake passageway 34 undergoes a lateral elbow bend prior to communicating with intake valve port 38. Disposed on the outside curve of the bend is a planar surface 124 oriented at about a 45° angle relative to the axis of passageway 34. Surface 124 is interrupted by a wedge-shaped ridge comprising a stoss side 126 rising at an angle of about 45° from a grade defined by surface 124 to a ridge peak 128, followed by a lee side 130 descending at an angle of about 45° back down to grade.

Summarizing the cross-sectional deviations of manifold 16 and the associated intake passageway 34 of cylinder head 14, it can be seen that each of the horizontal entrance runs, namely those following intake ports 92 and 36, encounters an abruptly rising ridge (94 and 120) followed by a flat section (96 and 122). Similarly, each of the elbow bends includes an initial inclined planar portion (98, 108, 124) interrupted by a wedge-shaped ridge comprising a planar stoss side (100, 110, 126), a ridge peak (102, 112, 128), and a planar lee side (104, 114, 130). The abruptly rising ridges each followed by a planar portion serve to introduce turbulence in the horizontal runs of the passages which aids in maintaining a homogeneous fuel/air mixture during low flow conditions. In addition, the planar portions located at each bend aid in spreading out fuel which tends to pool at such locations into a wide thin film which is then directed back into the air flow by the stoss sides of the wedge-shaped ridges so that the fuel film can be re-atomized at the ridge peaks where turbulence is generated. This provides additional aid in maintaining a homogeneous fuel/air mixture and helps prevent a sudden overrich condition occasioned by fuel puddling in the passageway at low flow conditions and then suddenly being drawn off upon acceleration of the engine.

While the present invention has been particularly described in the context of a preferred embodiment, it will be understood that the invention is not limited thereby Therefore, it is intended that the scope of the invention include any variations, uses or adaptations of the invention following the general principles thereof and including such departures from the disclosed embodiment as come within known or customary practice in the art to which the invention pertains and which fall within the appended claims or the equivalents thereof.

What is claimed is:

1. In an air-cooled internal combustion engine having an intake port and a carburetor, an intake manifold comprising:

an elongate manifold tube having at least one elbow bend having an outer wall, said manifold tube having a generally arcuate internal cross-section, the outer wall of said manifold tube at the elbow bend having a first planar internal surface, whereby the internal cross-section of said manifold tube undergoes transition from arcuate to flat at said elbow bend; and a ridge located on the first planar internal surface and oriented transverse to said manifold tube, said ridge comprising a stoss side rising from a grade defined by said first planar internal surface to a ridge peak, and a lee side descending from the ridge peak back to grade.

2. The internal combustion engine of claim 1, in which the stoss side of the ridge is planar.

3. The internal combustion engine of claim 2, in which the lee side of the ridge is planar.

4. The internal combustion engine of claim 1, and further including a second ridge rising from the arcuate cross-section of the manifold tube upstream of the ridge of the first planar surface.

5. The internal combustion engine of claim 4, in which the second ridge is followed by a second planar surface disposed between said second ridge and said first planar surface.

6. In an air-cooled internal combustion engine having an intake port and a carburetor, an intake manifold comprising:

an elongate S-shaped manifold tube having first and second elbow bends at opposite ends thereof, each of said elbow bends having an outer wall, said manifold tube having a generally arcuate internal cross-section, the outer wall of said manifold tube at said first elbow bend having a first planar internal surface, and the outer wall of said manifold tube at said second elbow bend having a second planar internal surface, whereby the internal cross-section of said manifold tube undergoes transition from arcuate to flat at each of said elbow bends; and a ridge located on each of the first and second planar internal surfaces and oriented transverse to said manifold tube, each said ridge comprising a stoss side rising from a grade defined by the respective planar internal surface to a ridge peak, and a lee side descending from the ridge peak back to grade.

7. The internal combustion engine of claim 6, in which the stoss side of the ridge is planar.

8. The internal combustion engine of claim 7, in which the lee side of the ridge is planar.

9. The internal combustion engine of claim 6, and including a further ridge rising from the arcuate cross-section of the manifold tube upstream of the ridge of the first planar surface.

10. The internal combustion engine of claim 9, in which the further ridge is followed by a further planar surface disposed between said further ridge and said first planar surface.

11. In an air-cooled internal combustion engine having a carburetor and a cylinder head having an intake port, an intake system comprising:

an elongate S-shaped manifold tube having first and second elbow bends at opposite ends thereof, each of said elbow bends having an outer wall, said manifold tube having a generally arcuate internal cross-section, the outer wall of said manifold tube at said first elbow bend having a first planar internal surface, and the outer wall of said manifold tube at said second elbow bend having a second planar internal surface, whereby the internal cross-section of said manifold tube undergoes transition from arcuate to flat at each of said elbow bends;

a ridge located on each of the first and second planar internal surfaces and oriented transverse to said manifold tube, each said ridge comprising a stoss side rising from a grade defined by the respective planar internal surface to a ridge peak, and a lee side descending from the ridge peak back to grade; and an intake passageway in said cylinder head communicating with said manifold tube and the intake port, said intake passageway having at least one elbow bend having an outer wall, said intake passageway having a generally arcuate internal cross-section, the outer wall of said intake passageway at the elbow bend having a planar internal surface, whereby the internal cross-section of said intake passageway undergoes transition from arcuate to flat at said elbow bend; and a ridge located on the planar internal surface of said intake passageway and oriented transverse to said intake passageway, said ridge comprising a stoss side rising from a grade defined by said planar internal surface of said intake passageway to a ridge peak, and a lee side descending from the ridge peak back to grade.

12. The internal combustion engine of claim 11, in which the stoss side of the ridge is planar.

13. The internal combustion engine of claim 12, in which the lee side of the ridge is planar.

14. The internal combustion engine of claim 11, and including a further ridge rising from the arcuate cross-section of the manifold tube upstream of the ridge of the planar surface.

15. The internal combustion engine of claim 14, in which the further ridge is followed by a further planar surface disposed between said further ridge and said planar surface.

16. The internal combustion engine of claim 11, and including a further ridge rising from the arcuate cross-section of the intake passageway upstream of the ridge of the planar surface of the intake passageway.

17. The internal combustion engine of claim 16, in which the further ridge is followed by a further planar surface disposed between said further ridge and said planar surface.

* * * * *